United States Patent [19]

Clifton

[11] Patent Number: 5,023,401

[45] Date of Patent: Jun. 11, 1991

[54] TWIST-ON SPRING CONNECTOR WITH BREAKAWAY WINGS

[75] Inventor: Richard B. Clifton, Leander, Tex.

[73] Assignee: Minnesota Mining and Manufacturing Company, St. Paul, Minn.

[21] Appl. No.: 561,699

[22] Filed: Aug. 2, 1990

[51] Int. Cl.[5] ..... H01R 4/22

[52] U.S. Cl. ..... 174/87

[58] Field of Search ..... 174/87, 138 F; 403/214, 403/396

[56] References Cited

U.S. PATENT DOCUMENTS

| | | | |
|---|---|---|---|
| 2,656,204 | 10/1953 | Blomstrand | 287/78 |
| 2,890,266 | 6/1959 | Bollmeier | 174/87 |
| 3,075,038 | 1/1963 | Schinske | 174/87 |
| 3,156,761 | 11/1964 | Schinske | 174/87 |
| 3,308,229 | 3/1968 | Burniston | 174/87 |
| 3,448,223 | 6/1969 | Thorsman | 174/87 |
| 3,676,574 | 7/1972 | Johansson et al. | 174/87 |
| 4,220,811 | 9/1980 | Scott | 174/87 |
| 4,691,079 | 9/1987 | Blaha | 174/87 |

*Primary Examiner*—Morris H. Nimmo

*Attorney, Agent, or Firm*—Gary L. Griswold; Walter N. Kirn; John C. Barnes

[57] ABSTRACT

A twist-on type spring connector comprised of a tapered coiled spring secured within a molded insulative shell having detachable wings, thereby allowing the connector to fit in cramped or crowded locations.

18 Claims, 2 Drawing Sheets

TWIST-ON SPRING CONNECTOR WITH BREAKAWAY WINGS

BACKGROUND OF THE INVENTION

1. Field of the Invention

The present invention generally relates to twist-on type spring connectors for splicing electrical wire ends, and more particularly to twist-on type spring connectors with space saving breakaway wings.

2. Description of the Prior Art

There have been a number of twist-on type spring connectors devised. Such connectors commonly consist of an insulative cap, sleeve, or shell that is closed on one end, with a tapered coiled spring retained within the shell. Such a connector is described by U.S. Pat. No. 2,890,266, issued to E. W. Bollmeier on June 9, 1959, and also by U.S. Pat. No. 3,676,574, issued to Johansson et al. on July 11, 1972. Prior art spring connectors that are comprised of a coiled spring and an insulative shell differ from each other primarily in how the coiled spring is retained in the insulative shell, and in how torque is transmitted from the insulative shell to the coiled spring.

To splice a plurality of electrical wires with a twist-on type spring connector, the ends of the wires are stripped of their insulation, and the tapered coiled spring of the connector is turned down on the wire ends. The insulative cap prevents the splice from shorting with other wires or ground, and protects against the possibility of electrical shock. Because the coiled spring is tapered, the connector can be used with a range of wire sizes, and is usually employed to connect from two to five wires in a single splice. Spring connectors have the advantages of small size and ease of application.

Many prior art connectors incorporate wings, ribs, ears, or the like, on the insulative shell to provide leverage for the operator so that the connector can be more easily twisted over the wire ends. However, a disadvantage of having wings on the connector is that the connector is now larger, and will not fit into as tight a place as a connector without wings. Small size, or compactness, has always been a desirable feature of spring connectors. U.S. Pat. No. 3,308,229, issued to R. S. Burniston on Mar. 7, 1967 describes a spring connector with wings that can fold out to provide extra leverage, and then fold back and snap into the insulative housing for compactness. However, to produce this connector, a complicated and prohibitively expensive molding process is required. In U.S. Pat. No. 3,075,038, issued to W. G. Schinske on Jan. 22, 1963, it is suggested that the wings can be cut off using a pair of electrician's pliers after the spring connector is turned down over the wire ends. However, it may be difficult to use mechanical means to remove the wings in some instances, such as when the splice is being made in a small or crowded junction box, or when a suitable tool to cut the wings is not available. It would therefore be desirable to have a spring connector with the advantage of wings that are easily detachable without the use tools. It is also desirable that the connector be easily and inexpensively manufactured.

Accordingly, the present invention provides a twist-on type spring connector having wings that can be easily detached, without the use of tools, after the connector is installed on electrical wire ends.

SUMMARY OF THE INVENTION

The foregoing advantage is achieved in a twist-on type spring connector comprising a coiled spring secured within an insulative shell having wings joined to the shell by frangible sections.

The insulative shell has an integral skirt portion that provides additional protection to the stripped ends of the spliced wires. In addition, the insulative shell has longitudinal grooves spaced around its circumference so that a better grip can be achieved when manually installing or removing the connector. The insulative shell is also provided with wings which enable the connector to be more easily screwed onto the wire ends. In the invention, these wings are constructed so that they provide leverage when twisting the connector down on the wire ends, yet are easily detachable after the connector is installed, by applying a twisting force to the wings in the opposite direction. The wings can also be severed from the insulative shell by simply tearing or ripping them off.

BRIEF DESCRIPTION OF THE DRAWINGS

The invention will be further described by reference to the accompanying drawing, wherein.

DESCRIPTION OF THE PRESENTLY PREFERRED EMBODIMENT

Figure 1:
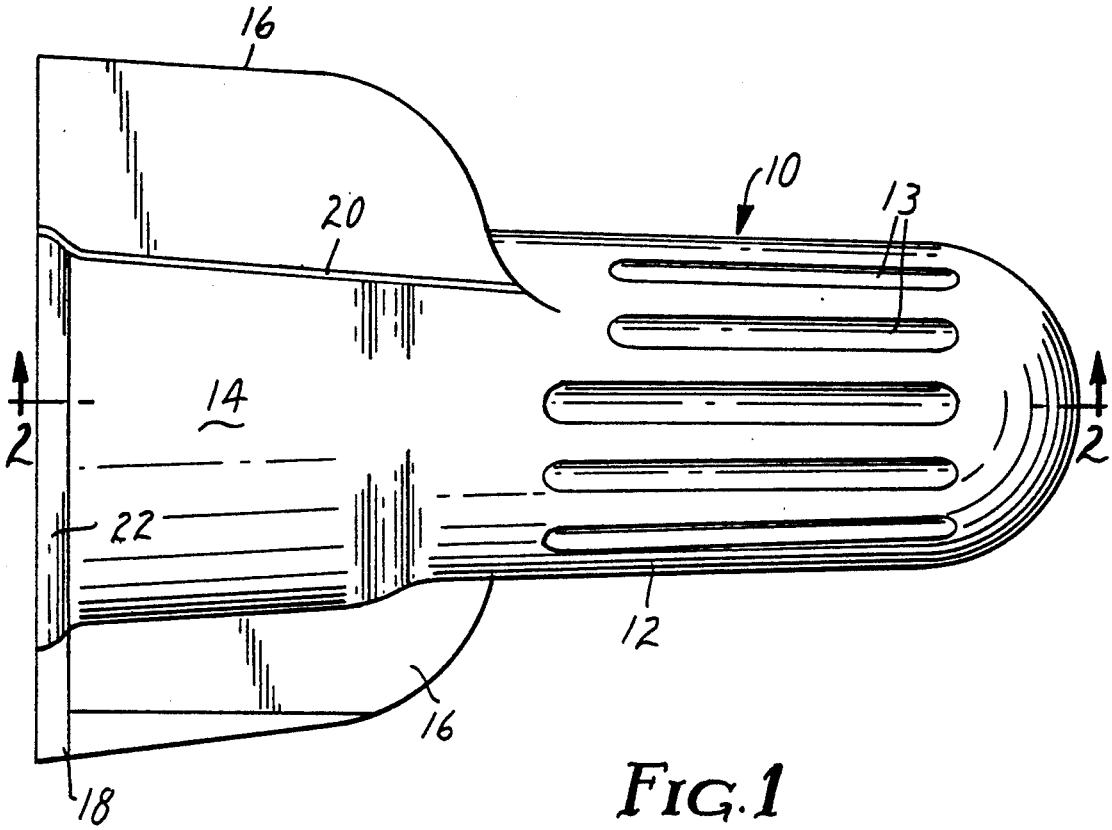
FIG. 1 is a side view of the preferred embodiment of the twist-on type spring connector.

With reference now to the figures, and in particular to FIG. 1, there is depicted a twist-on type spring connector 10 comprised of a tapered coiled spring 24 (see FIG. 2) housed within insulative shell 12. Insulative shell 12 is molded of nylon or polypropylene, and is generally cylindrical and slightly conical, having an open end and a rounded closed end. Longitudinal grooves 13 are molded on the exterior surface of insulative shell 12 in a parallel, evenly spaced, arrangement to provide for a better grip when installing or removing the connector from wire ends. Integral with shell 12 is an elongated skirt portion 14 that is enlarged to provide clearance for a plurality electrical wires having insulation thereon, and the longitudinal length providing insulation for the stripped ends of the electrical wires. Skirt portion 14 protects the splice from shorting with ground or other wires, and protects persons from the electrical shock hazard. Integrally molded reinforcement rib 22 is flush with, and completely encircles the open end of skirt portion 14.

A plurality of wings 16 are spaced around the circumference of insulative shell 12. In the preferred embodiment, two wings 16 are used, spaced 180° apart, and extend in a generally radially outward direction therefrom to provide leverage for twisting the connector 10 on a plurality of wires. Wings 16 are formed integrally with gussets 18 which are positioned to engage the reinforcement rib 22 when the wings are forced in a direction to twist and drive the spring over the wires. The wings 16 are attached to the insulative shell 12 by a frangible area 20 at the junction of wings 16 and insulative shell 12. Wings 16 extend onto skirt portion 14, but it is not necessary that they do so.

Figure 2:
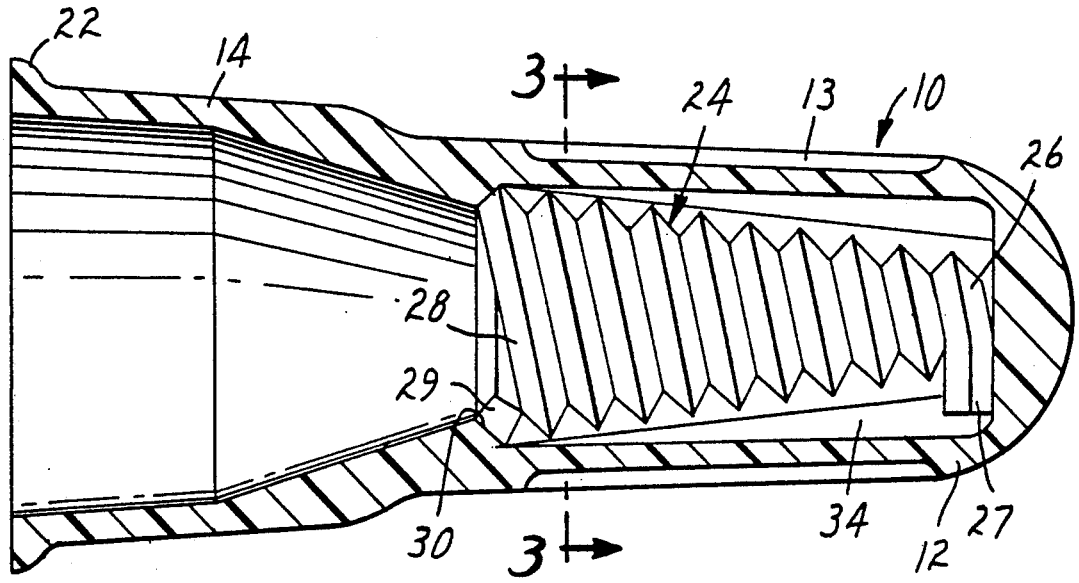
FIG. 2 is a longitudinal sectional view along the line 2—2 in FIG. 1.

Referring now to FIG. 2, the coiled spring 24 has the shape of a conical helix. Coiled spring 24 is constructed from spring steel wire having a square cross section, and is coated with zinc or tin, either by electroplating or by a mechanical process, to prevent corrosion. A corner of the square cross section of the wire faces out, such that the resulting tapered coiled spring 24 has the appearance of a screw thread shape. In the preferred embodiment, coiled spring 24 is wound so that there is little or no space between each coil. However, this is not essential, coiled spring 24 can be wound more loosely if desired and still provide a tight connection.

Figure 3:
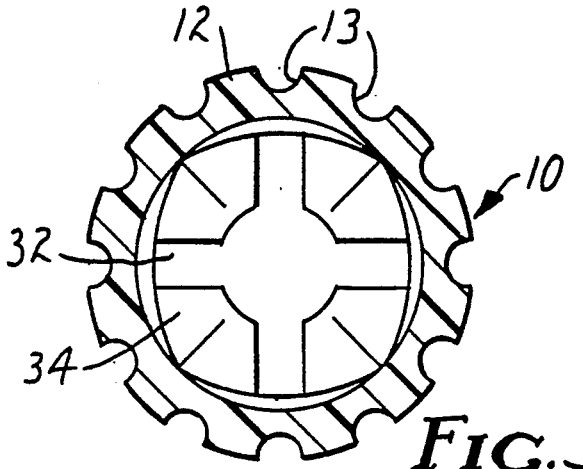
FIG. 3 is a sectional view along the line 3—3 in FIG. 2, with the tapered coiled spring removed.

At the small end 26 of tapered coiled spring 24, the wire projects tangentially out from the last coil. This tangential portion 27 of small end 26 fits in groove 32 (see FIG. 3) at the closed end of insulative shell 12. Rib 34 is tapered to help guide the tangential portion 27 of small end 26 into groove 32 as coiled spring 24 is being inserted into insulative shell 12. As connector 10 is turned onto the stripped ends of electrical wires, torque is transferred from the insulative shell 12 to coiled spring 24 by way of rib 34 and tangential portion 27, to prevent coiled spring 24 from twisting relative to insulative shell 12. The last coil of large end 28 has tangential portion 29 which projects away tangentially and abuts against the inside face of collar 30 when coiled spring 24 is fully inserted into insulative shell 12. This arrangement secures coiled spring 24 inside of insulative shell 12.

To splice a plurality of electrical wires together, the stripped ends of the wires are inserted collectively through the open end of connector 10, and into the large end 28 of coiled spring 24. Coiled spring 24 is twisted on the wires in a clockwise direction. As the connector 10 is twisted on the wires, coiled spring 24 forms threads on the wires, and radially expands around the wires to provide a tight compression connection that can be loosened by unscrewing the connector in a counter clockwise direction. Wings 16 are provided to afford leverage, thus enabling an operator to manually twist connector 10 over a plurality of wires. Wings 16 have a frangible area 20 that allows wings 16 to be removed by giving a counter-clockwise twist after the connector has been installed on the wires. Wings 16 can also be removed by simply tearing or ripping them off.

Figure 4:
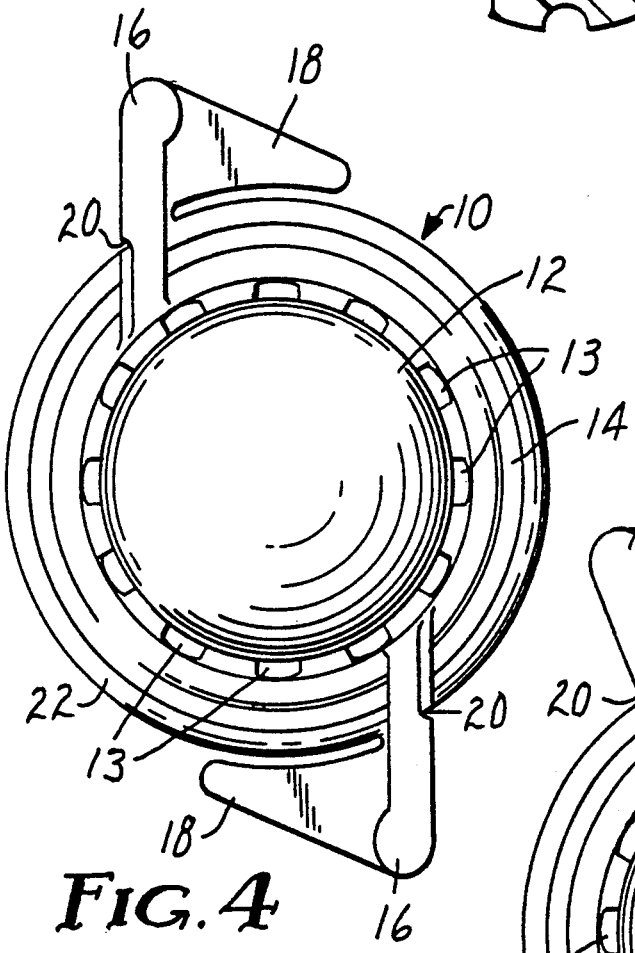
FIG. 4 is a top plan view of the connector showing details of the breakaway feature of the wings.
Figure 5:
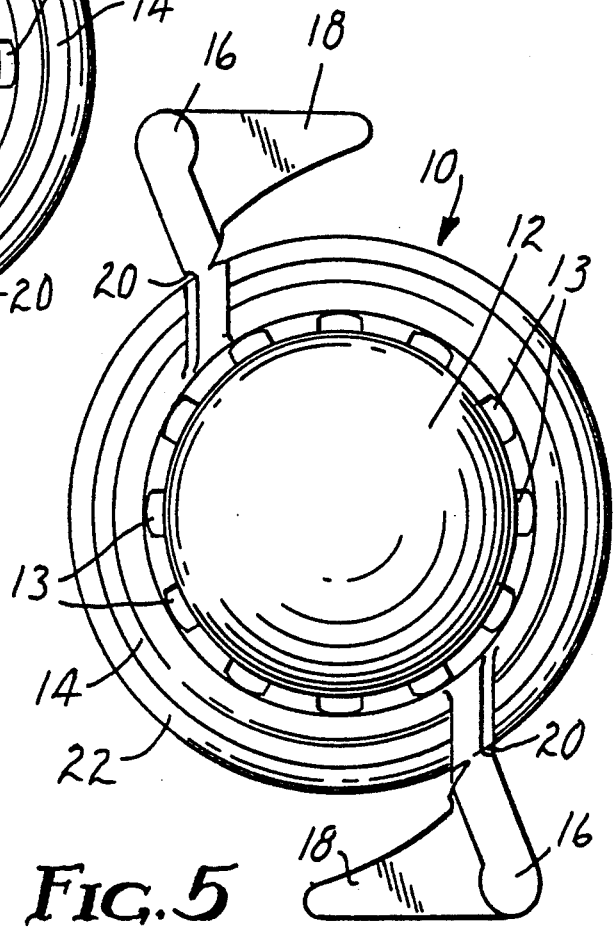
FIG. 5 is a top plan view of the connector showing the wings in the process of being detached.

Detail of the breakaway feature of wings 16 is shown in FIGS. 4 and 5. FIG. 4 depicts a top plan view of connector 10 with wings 16 attached to insulative shell 12 in their normal position, as when the insulative shell 12 is rotated in a clockwise direction for tightening. If insulative shell 12 is molded from nylon, wing 16 is molded relatively thinly, requiring that a gusset 18 be incorporated into each wing 16 for added strength. Gusset 18 is integrally molded into wing 16, and extends partially around the circumference of, and resting against, reinforcement rib 22. In the preferred embodiment, the bottom edge of gusset 18 only rests against reinforcement rib 22 and is not physically attached, however, it could be attached if desired. If insulative shell 12 is molded from polypropylene, the wings 16 may be molded thick enough so that gusset 18 is not necessary to provide additional strength.

Frangible area 20, at the junction of wing 16 and insulative shell 12, is preferably constructed by molding frangible area 20 thinner than wing 16, in a manner similar to that used for forming a living hinge. However, for frangible 20, the thin area is offset to one side of wing 16 so that there is the appearance of a notch, or channel on one side, and a smooth surface on the other. The notch or channel appears on the side of wing 16, opposite the side from which the force is to be applied to remove wing 16. Molding frangible area 20 in this way utilizes the same principle that permits a tree to fall in a particular direction depending on which side of the tree the notch is cut. Frangible area 20 is preferably constructed by molding it integrally into wing 16, however it can also be constructed by performing a secondary operation after molding, such as cold stamping or forming.

FIG. 5 shows a top plan view of connector 10 with the wings in the process of being detached. A counter clockwise force is applied to wings 16, which causes them to break off in the thinly molded breakaway area 20. Even though wings 16 are broken off, connector 10 can still be removed from the wires by utilizing mechanical means, such as pliers, or the like.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

I claim:

1. A twist-on type spring connector comprising:

a hollow insulative shell closed at one end and open at the other end, and a coiled spring retained in said shell;

said coiled spring having a small first coil and a large last coil, said small first coil disposed toward the closed end of said insulative shell and said large last coil disposed toward the open end of said insulative shell;

said coiled spring tapering substantially conically from said large last coil to said small first coil;

said connector having means for transferring the twisting force to said coiled spring from said insulative shell when said connector is turned down on a plurality of electrical wires, to prevent said coiled spring from twisting relative to said insulative shell;

said insulative shell having a plurality of wing to be connected means arranged to enable said connector to be turned down on the electrical wires with greater twisting force; and frangible means for securing said wing means to said insulative shell, for providing support for said wing means when transferring force from said wing means to said insulative shell, and for removing said wing means from said insulative shell.

2. The connector of claim 1 wherein said insulative shell has an integral skirt portion projecting substantially longitudinally from its open end.

3. The connector of claim 1 wherein said coiled spring is made of spring steel wire having a substantially square cross section.

4. The connector of claim 2 wherein said wing means extends onto and is integral with said skirt portion.

5. The connector of claim 1 wherein a plurality of longitudinal grooves are substantially evenly spaced around the circumference of said insulative shell.

6. A twist-on type spring connector comprising:

a hollow molded insulative shell closed at one end and open at the other end, and a coiled spring retained in said shell;

said coiled spring having a small first coil and a large last coil, said small first coil disposed toward the closed end of said insulative shell and said large last coil disposed toward the open end of said insulative shell;

said coiled spring tapering substantially conically from said large last coil to said small first coil;

said connector having means for transferring the twisting force from said coiled spring to said shell when said connector is turned down on a plurality of electrical wires to prevent said coiled spring from twisting relative to said insulative shell;

said shell having a plurality of integrally molded wings placed substantially longitudinally along its exterior surface, said wings to be connected arranged to enable said connector to be turned down onto the stripped ends of the electrical wires to be connected with greater twisting force; and said wings having a frangible means in the areas where said wings join said insulative shell, said frangible means providing support for said wings when said connector is turned down on the wire ends of the electrical wires to be connected and said frangible means permitting said wings to be easily removed from said shell after said connector is turned down onto the electrical wires to be connected.

7. The connector of claim 6 wherein said insulative shell has an integral elongated skirt portion projecting substantially longitudinally from its open end.

8. The connector of claim 6 wherein said coiled spring is made of spring steel wire having a substantially square cross section.

9. The connector of claim 7 wherein said wings extend onto, and are integral with, said skirt portion.

10. The connector of claim 6 wherein a plurality of longitudinal grooves are substantially evenly spaced around the circumference of said insulative shell.

11. The connector of claim 6 wherein said wings each have gusset means for providing support for said wings as said connector is twisted down onto the electrical wire ends to be connected.

12. A twist-on type spring connector for connecting a plurality of electrical wire ends comprising:

a generally cylindrical hollow molded insulative shell having a closed end and an open end, and a coiled spring retained in the cavity of said shell;

said coiled spring having a small first coil and a large last coil, said small first coil disposed toward the closed end of said insulative shell and said large last coil disposed toward the open end of said insulative shell;

said coiled spring tapering substantially conically from said large last coil to said small first coil;

said small first coil having a tangential portion extending outward for engagement with a groove in said closed end of said insulative shell, thereby transferring the twisting force from said coiled spring to said insulative shell when said connector is turned down onto electrical wire ends to be connected to prevent said coiled spring from twisting relative to said insulative shell;

said large last coil having a tangential portion extending outward for engagement with a rib at said open end of said insulative shell for retaining said coiled spring in said insulative shell;

said insulative shell having a integral skirt portion at said open end extending longitudinally away from said open end for providing additional insulative protection to the electrical wire ends to be connected;

said insulative shell having two integrally molded wings placed substantially longitudinally along its exterior surface and extending to the open end of said skirt portion, said wings being arranged to permit said connector to be more easily turned down onto the stripped electrical wire ends to be connected; and said wings being frangible in the areas adjacent to where said wings join said insulative shell, said frangible areas affording support to said wings when said connector is turned clockwise onto the electrical wire ends to be connected and permitting said wings to be detached from said insulative shell when a counter clockwise twisting force is applied to said wings.

13. The connector of claim 12 wherein said skirt portion is enlarged to accommodate wires having bulky insulation.

14. The connector of claim 12 wherein said coiled spring is made of spring steel wire having a substantially square cross section.

15. The connector of claim 12 wherein said wings each have an integral gusset that provides additional support for said wings as said connector is twisted down onto the electrical wire ends to be connected.

16. The connector of claim 15 wherein said qusset is affixed to said wing where said wing meets the open end of said skirt portion, said gusset extending away and substantially perpendicular to said wing and partially around and against the circumference of said skirt portion in the direction that a twisting force would be applied to turn said connector onto the electrical wire ends to be connected.

17. The connector of claim 12 wherein said insulative shell is molded of one of the materials, nylon and polypropylene.

18. The connector of claim 12 wherein each wing is formed with a notch along the side of the wing at the side where the clockwise force is applied to the wings to assist detaching said wings.

* * * * *

UNITED STATES PATENT AND TRADEMARK OFFICE

CERTIFICATE OF CORRECTION

PATENT NO. : 5,023,401
DATED : June 11, 1991
INVENTOR(S) : Richard B. Clifton

It is certified that error appears in the above-indentified patent and that said Letters Patent is hereby corrected as shown below:

Column 4, line 49, delete "to be connected".

Column 4, line 51, after "wires" should read--to be connected--

Signed and Sealed this

Third Day of January, 1995

Bruce Lehman

*Attest:*

BRUCE LEHMAN

*Attesting Officer*

*Commissioner of Patents and Trademarks*